United States Patent [19]

Moore et al.

[11] 3,979,876

[45] Sept. 14, 1976

[54] CARTON SEALER SYSTEM

[75] Inventors: Billy R. Moore, Vidalia; J. David Williams, Winder; William O. Mitchell, Vidalia, all of Ga.

[73] Assignee: Oxford Industries, Inc., Atlanta, Ga.

[22] Filed: May 28, 1975

[21] Appl. No.: 581,701

[52] U.S. Cl. ..... 53/38; 53/76; 53/381 A; 53/383; 53/387

[51] Int. Cl.[2] ..... B65B 7/28; B65B 51/02

[58] Field of Search ..... 53/38, 40, 109, 287, 53/76, 289, 381 A, 383, 387

[56] References Cited

UNITED STATES PATENTS 2,828,593 4/1958 Colgren et al. ..... 53/381 A 3,038,284 6/1962 Kaestner ..... 53/383

*Primary Examiner*—Travis S. McGehee

*Attorney, Agent, or Firm*—Jones, Thomas & Askew

[57] ABSTRACT

A carton sealer system moves a plurality of boxes with telescoping upper and lower sections along a horizontal conveyor path, and the top sections are lifted to expose the side walls of the bottom section. Adhesive is applied to the exposed side walls of the bottom sections, the top sections are urged downwardly to their fully closed positions, and the top wall of the top section is urged downwardly and the side walls are pressed inwardly to expel the air from the box and to seal the sections of the box together.

12 Claims, 3 Drawing Figures

CARTON SEALER SYSTEM

BACKGROUND OF THE INVENTION

In the shipping of commercial goods, such as garments in the clothing industry and other nonbreakable soft materials, it is sometimes desirable to lay the products in a relatively flat carton or box of the type that includes a bottom section with a bottom wall and upwardly extending side walls and a top section with a top wall and downwardly extending side walls that telescope over the side walls of the bottom section. When the boxes have been packed with the product, it is desirable to press the top section of the box downwardly toward the bottom section so as to pack the goods tightly in the box and to expel the air from the box and to seal the box closed in this condition. Since the boxes are to be tightly packed, it is desirable not to use staples or other penetrating devices but to use glues, tapes or other externally applied devices for keeping the boxes closed. While the least expensive substance used for keeping the boxes closed is an adhesive, the closing and sealing of boxes is commonly accomplished by hand, by having a worker apply adhesive to the external side walls of the bottom section of a box and then place the top section in telescoping relationship over the bottom section and press the top section downwardly to expel the trapped air from the box and to close the box. The manual steps required in closing and sealing boxes are onerous, and the workers frequently do not cause the top sections to be pressed firmly downwardly onto the bottom sections, and occasionally the adhesive applied to the bottom section is inadvertently spread to other surfaces, including the products packed in the boxes, through errors by the workers handling the boxes. Also, in the manual closing and sealing of the boxes, the top sections of the boxes frequently are not sealed evenly onto the bottom sections, which may allow the products in the box to shift and become wrinkled or otherwise damaged, and when a plurality of such boxes are stacked, the improperly packed boxes may become partially crushed or the stack of boxes may be out of alignment with and uneven with the other stacks of boxes.

SUMMARY OF THE INVENTION

Briefly described, the present invention comprises a box sealing system wherein boxes are conveyed in series at spaced intervals through a series of work stations. The boxes are packed with the product, the top section is closed over the bottom section, and the boxes are not opened again before leaving the manufacturer. Each packed box is received at the first work station with the top section positioned in closed telescoped relationship over the bottom section, and the top section is lifted to expose the side walls of the bottom section. Glue is applied to the exposed side walls of the bottom section as the box leaves the first work station and moves through a second work station. The top section of the box is pressed downwardly in telescoping relationship with the bottom section to close the box at a third work station, and the sides of the box and the top of the box are pressed to expel air from the box and to close the box tightly while the glue is setting at a fourth work station.

Thus, it is an object of the present invention to provide a system for sealing cartons or boxes which performs automatically, rapidly and uniformly to secure the top section of a telescoping box to its bottom section.

Other objects, features and advantages of the present invention will become apparent upon reading the following specification, when taken in conjunction with the accompanying drawing.

DESCRIPTION OF THE EMBODIMENT

Figure 1:
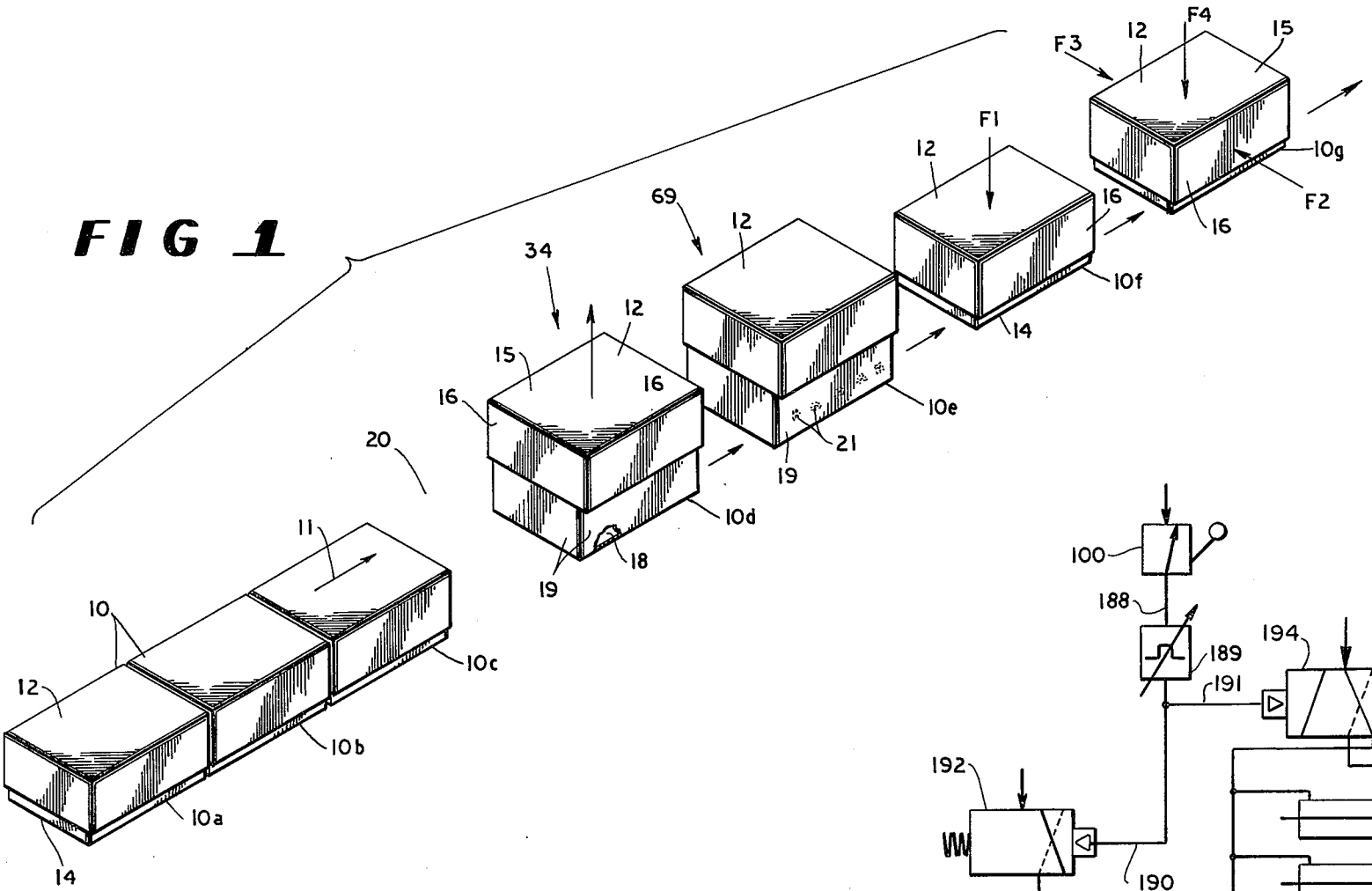
FIG. 1 is a schematic illustration of the steps taken in the carton sealer system.

Referring now in more detail to the drawing, in which like numerals indicate like parts throughout the several views, FIG. 1 illustrates a series of boxes or cartons 10 moving along a rectilinear path as indicated by arrow 11. Each box 10 includes a top section 12 and a bottom section 14. The top section 12 includes top wall 15 and downwardly extending side walls 16. Each bottom section 14 includes bottom wall 18 and upwardly extending side walls 19. Top section 15 of each box are slightly larger than the bottom sections 14 and the downwardly extending side walls 16 of each top section extends about the upwardly extending side walls 19 of the bottom section in a snug telescoping relationship.

The boxes are transported on a surface conveyor system and as the boxes move into the carton sealing system, spaces 20 are formed between the boxes, by holding back the boxes on the conveyor system so as to allow the preceding box to move ahead. For example, boxes 10*a*, 10*b* and 10*c* will be held back by blocking the movement of box 10*c*, and boxes 10*d*, 10*e*, 10*f* and 10*g* will continue to move on the conveyor system through the working stations of the system. At the first working station 34 the top section 12 of the box 10*d* is lifted upwardly to telescope the top section upwardly with respect to the bottom section 14. This exposes the side walls 19 of the bottom section 14. As the boxes move from the first work station 34 as illustrated at 10*d* through the second work station 69 as indicated at 10*e*, liquid glue or other adhesive is applied to the exposed portions of the side walls 19 of the bottom section 14 of each box. The adhesive 21 is applied to the opposite side walls which extend along the path of movement of the boxes. As the boxes move from the second work station 69 through the third work station 71 as indicated at 10*f*, a downward force $F_1$ is applied to the top section 12 of each box to urge the top section in a downward telescoping movement with respect to the bottom section 14, expelling air from the box and causing the box to close and have the side walls 16 cover the adhesive 21. The box is then moved to the last work station 81 as indicated at 10*g* where the side walls 16 of the top section 12 are pressed inwardly as indicated by forces F2 and F3 and the top wall 15 is also pressed downwardly as indicated by the force F4. The forces F2, F3 and F4 tend to expel the excess air from the boxes, and the pressing forces F2 and F3 tend to urge the side walls 16 of the top section 12 into positive contact with the side walls 19 of the bottom section 14, so that the adhesive will seal the side walls of the top and bottom sections together.

Figure 2:
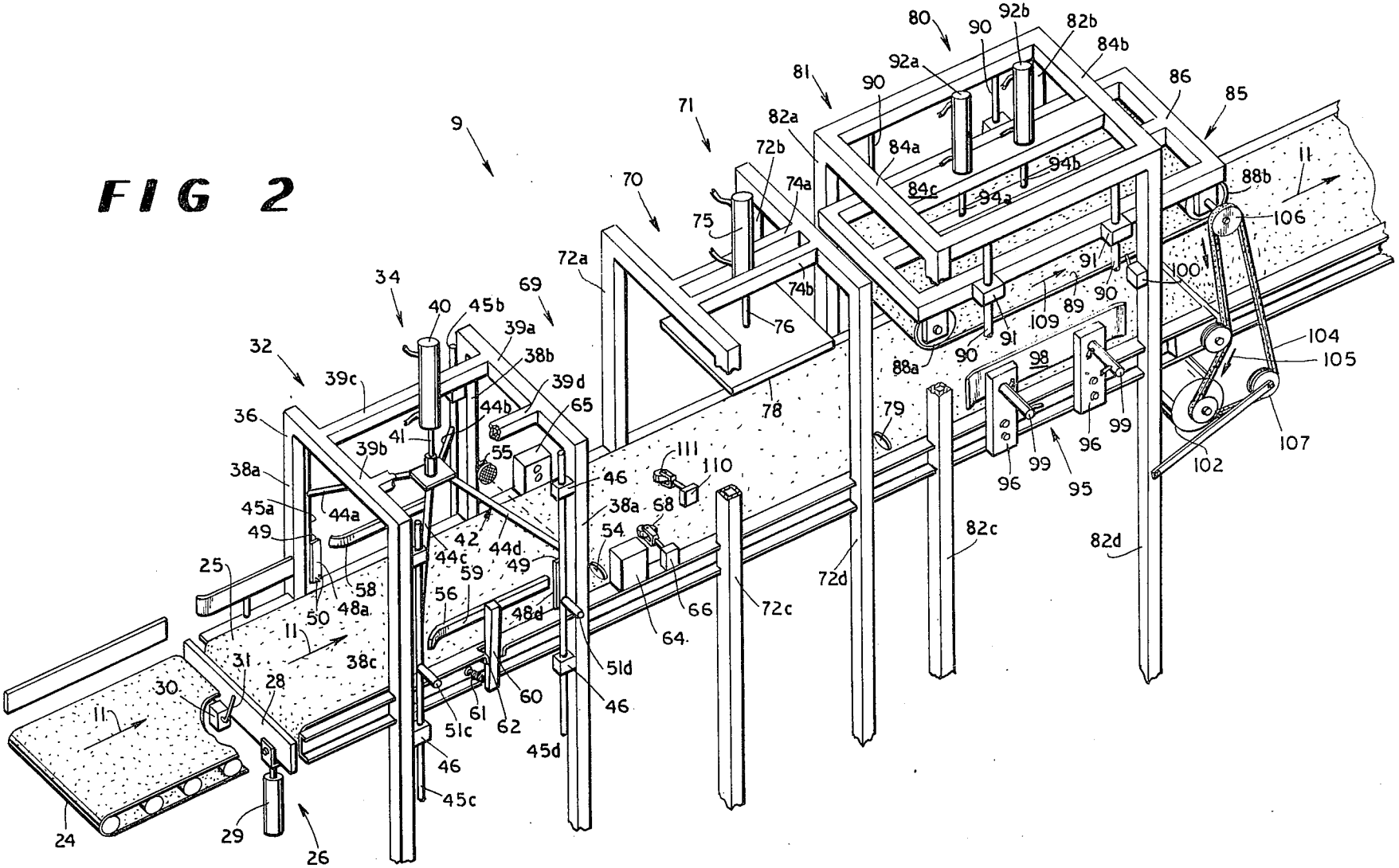
FIG. 2 is a perspective view of the carton sealer system with parts removed for clarity.

As is illustrated in FIG. 2, the carton sealing system 9 is inserted in a conveyor line, with the last conveyor section 24 of the conveyor line functioning as part of the surface conveyor system for the carton sealing system. The carton sealing system includes its own surface conveyor 25 which can be a belt conveyor as illustrated, a roller conveyor or any other conveyor that positively moves the boxes as indicated by arrows 11. Parts of the supporting framework and other associated elements of the conveyor are not illustrated in FIG. 2, for convenience.

Control gate 26 is positioned between surface conveyor 24 and surface conveyor 25 and includes gate element 28, gate ram 29 and control valve 30. When a box engages the actuator 31 of the gate control valve 30, the rams 29 function to move gate element 28 down and out of the way of an oncoming box for a short time interval sufficient to allow the leading end and a major portion of the length of the box to move over the gate element, whereupon the rams 29 will move the gate element back to its up or closed position and prevent the next oncoming box to pass from the first surface conveyor 24 to the surface conveyor 25. This creates a space between the oncoming boxes.

The lid lifting apparatus 32 is located at the first work station 34 and includes a supporting framework 36 that includes four upright legs 38*a*, 38*b*, 38*c* and 38*d* and upper braces 39*a*, 39*b*, 39*c* and 39*d*. A double acting fluid actuated ram 40 is mounted on the braces 39*a*–39*d* with its ramrod 41 extending in a downward direction. The lower end of the ramrod 41 is connected to a reciprocating support spider assembly 42 that includes downwardly inclined radiating legs 44*a*, 44*b*, 44*c*, and 44*d*. The outer lower ends of each spider leg 44*a*–44*d* is connected to reciprocating guide rods 45*a*, 45*b*, 45*c* and 45*d*, and each guide rod 45*a*–45*d* is slidably received at its lower and upper ends in slide blocks 46 connected to each support leg 38*a*–38*d* of the framework. A box engaging plate such as the plates 48*a* and 48*d* is connected to each guide rod 45*a*–45*d*, and each plate is pivotally connected with a hinge connection at its upper end at 49 to its guide rod, and pins or other projections 50 protrude outwardly from their lower ends toward the space above the surface conveyor 25. Double acting fluid actuated rams such as ram 51*c* and 51*d* are mounted on the outside surfaces of the guide rods 45*a*–45*d* and their ramrods (not shown) are connected to the box engaging plates 48*a*–48*d* and function to pivot the box engaging plates about their hinge connections, to move the pins 50 and the lower ends of the box engaging plates inwardly and outwardly over the edge of surface conveyor 25.

Photoelectric cell 54 is mounted adjacent support leg 38*d* of the framework and its reflector 55 is mounted adjacent the opposite leg 38*d*. Photoelectric cell 54 is the first photocell along the path of the boxes and is arranged to receive light reflected from the reflector 55, and when a box 10 moves between the photoelectric cell 54 and its reflector 55, rams 40 and 51*a*–51*d* are actuated for a time duration. Ram 40 is retracted to lift the reciprocating support spider assembly 42 while rams 51*a*–51*d* are distended to move their box engaging plates 48*a*–48*d* inwardly to engage the opposite side walls 16 of a top section of a box, whereupon the pins 50 of the box engaging plates impale the outside surfaces of the side walls of the top section of the box and the top section 12 of the box is lifted.

Top section support rails 56 and 58 are mounted on opposite sides of the surface conveyor 25 and each includes a support rail 59, support lever 60 and coil compression spring 61. The lever 60 is pivotally mounted intermediate its ends on the conveyor framework by pivot pin and hinge assembly 62, and the support rail 59 is urged inwardly by the compression spring 61. The rail 59 of each top section support rail 56 and 58 extends in a horizontal attitude along the path of travel of the boxes through the first work station 34 and the rails are located at a level where they will be positioned above the bottom edge of the side walls of the top section of a box when the box is first received in the first work station, and when the reciprocating support spider assembly 42 lifts the top section of a box upwardly, the bottom edges of the side walls of the box will move above the top section support rails 56 and 58. The coil compression spring 61 of each top section support rail 56 and 58 will cause the rail 59 to move inwardly beneath the bottom edge of the side walls of the top section of the box and against the side walls of the bottom section of the box so that the top section support rails 56 and 58 will support the top section of the box and maintain it in its lifted position. The bottom section of the box will be allowed to remain on the surface conveyor 25 as the top section is being lifted, or if the vacuum created by the lifting of the top section of the box is sufficient to also lift the bottom section of the box, the top section rails 56 and 58 will hold the top section of the box in its lifted position while the bottom section tends to drift downwardly back into contact with the surface conveyor 25 as the vacuum inside the box is depleted.

When the reciprocating support spider assembly 42 first engages and lifts the top section of the box, the movement of the box on the surface conveyor 25 is interrupted until the reciprocating support spider assembly 42 releases the box, and if the bottom section of the box has also been lifted away from the surface conveyor 25, the box will not resume its movement with the conveyor until the bottom section of the box re-engages the surface conveyor 25.

As the box leaves the first work station and continues to move with the surface conveyor 25 it passes the glue applicators 64 and 65 which are located on opposite sides of the surface conveyor 25 at a height where they can apply liquid glue to the exposed side walls of the bottom section of the boxes which extend along the path of movement of the box as the boxes leave the first work station. Actuator valve 66 is located adjacent the surface conveyor 25 and its actuator 68 is engaged by an oncoming box. The glue applicators 64 and 65 are energized by the valve 66 and function for a predetermined time duration to spray liquid adhesive onto the outside exposed surfaces of the side walls of the bottom section of the box. The spraying of the glue is accomplished as the box moves progressively through the second work station 69. The top section of the box continues to be held in its lifted position by the top section support rails 56 and 58 at the first work station as the box moves from the first work station through the second work station, and the air inside the box tends to maintain the top section in its lifted position after the box leaves the first work station and moves through the second work station.

A box closer assembly 70 is located at the third work station 71 and includes upright support legs 72*a*, 72*b*, 72*c* and 72*d* and upper braces 74*a* and 74*b*. Double acting fluid actuated ram 75 is supported by braces 74*a* and 74*b* and its ramrod 76 extends in a downward direction and is connected to and supports presser plate 78. Photoelectric cell 79 is mounted adjacent upright support leg 72*d* and its reflector is positioned across the surface conveyor 25. When a box moves into the path of light reflected from the reflector to the photoelectric cell 79, the photoelectric cell 79 causes ram 75 to distend its ramrod and move the presser plate 78 in a downward direction, thereupon applying the force F1 to the top section 12 of the box at the third work station 71. The top section of the box is then forced in a downward closing direction and is telescoped over the bottom section, so that its side walls 16 move over and cover the glue 21 which has been applied to the previously exposed side walls of the bottom section of the box. A substantial amount of the air in the previously expanded box is expelled by the box closer assembly 70.

A box presser assembly 80 is located at the fourth work station 81 and includes a supporting frame comprising upright support legs 82*a*, 82*b*, 82*c* and 82*d* and upper connecting legs 84*a*, 84*b* and 84*c*. A movable compresser conveyor assembly 85 is supported by the framework of the box presser assembly 80 and includes conveyor framework 86 which supports conveyor rollers 88*a* and 88*b* and conveyor belt 89. Guide rods 90 are rigidly connected at their upper ends to and extend downwardly from the supporting framework of the box presser assembly 80, and the slide blocks 91 are mounted on the framework 86 of the movable presser conveyor assembly 85 and extend about the guide rods 90. The guide rods 90 and slide blocks 91 function to allow the movable presser conveyor assembly 85 to reciprocate in vertical directions over the surface conveyor 25. Double acting fluid actuated rams 92*a* and 92*b* are supported by the box presser assembly framework and their ramrods 94*a* and 94*b* extend downwardly and are connected to the framework 86 of the movable presser conveyor assembly 85 and control the reciprocation of the movable presser conveyor 85.

Side presser assemblies 95 (only one shown) are part of the box presser assembly 80 and are mounted on opposite sides of the surface conveyor 25 beneath the movable presser conveyor assembly 85. Each side presser assembly 95 includes support blocks 96 mounted on the framework of the surface conveyor 25, presser fender 98 and double acting fluid actuated rams 99 mounted in each support block. The ramrods (not shown) of the rams 99 are connected at their ends to the presser fender 98, and the rams 99 function to reciprocate the presser fenders inwardly and outwardly in horizontal directions over the edge portions of the surface conveyor 25. Box presser actuator valve 100 is mounted adjacent support legs 82*d* of the box presser assembly 80 and its actuator lever 101 is engaged by an oncoming box. The box presser actuator valve 100 functions to distend rams 99 of the side presser assemblies 95 and to move the presser fenders 98 inwardly, whereupon the side walls 16 of the top section of the box are pressed inwardly by the presser fenders 98.

Drive motor 102 is mounted beneath the surface conveyor 25 and its sheave drives the conveyor driving belt 104 in the direction as indicated by arrow 105 to move the belt 25 of the surface conveyor 25 in the direction required to move the boxes through the system. Belt 104 also extends about sheave 106 of movable presser conveyor 85 and causes the lower flight of belt 89 to move in the direction indicated by arrow 109. Idler sheave 107 is spring urged downwardly to keep the slack out of belt 104. Thus, the surface conveyor 25 as well as the movable presser conveyor assembly 85 tend to drive the boxes on through the carton sealer system.

In order that the desired amount of air be present in the box leaving the box sealer system, and in order to assure that the box is properly sealed, it is desirable to hold the box in the box presser assembly 80 for a predetermined period of time. Thus, box presser control valve 100 functions to not only actuate the side presser assemblies 95 to apply the forces F2 and F3 to the sidewalls of the top section of the box, but also to terminate the driving action of motor 102, to stop the surface conveyor 25 and to stop the movement of the conveyor belt 89 of the movable presser conveyor assembly 85. Thus, the box in the box presser assembly 80 pauses for a short time duration to allow the leakage of the last air from the box and to allow the glue to set. When the time runs out, the side presser assemblies 95 retract and the surface conveyor 25 and movable presser conveyor assembly 85 resume their movement.

From the preceding description, it will be noticed that a movement of the surface conveyor 25 is interrupted by the box presser assembly 80 so that a box can be held at the box presser assembly to expel the air from the box and to press the sides inwardly to assure that the box is sealed. Also, the movement of each box is interrupted at the first work station 34 when the reciprocating support spider assembly 42 engages the top section of a box and lifts it. If the bottom section of the box continues to rest on the surface conveyor 25 as the top section is lifted, the gripping of the top section of the box will interrupt the movement of the box on the surface conveyor. In most circumstances, not only the top section of the box but also the bottom section of the box will be lifted by the box lifter 32 since the downwardly telescoping action of the bottom section of the box tends to create a vacuum inside the box, so that the bottom section does not telescope downwardly as fast as the top section is lifted upwardly. If the bottom section is lifted out of engagement with the surface conveyor 25, the box is no longer driven by the surface conveyor. Even after the reciprocating support spider assembly 42 releases the top section of the box, where the lower edges of the sidewalls of the top section of the box rest on the top section support rails 56 and 58, the bottom section of the box may not have telescoped out of the top section to have reached the surface conveyor 25. This short time delay usually lasts for a period less than the time delay experienced by a box in the box presser assembly 80. The speed of the system is calibrated so that a box will usually reach the first work station 34 just prior to the time when a box reaches the box presser assembly 80, so that the cycle of the box lifter 32 will begin just before the cycle of the box presser assembly 80 begins. Thus, when the operation of the surface conveyor 25 has been interrupted by the box presser assembly 80, a box will be undergoing its opening cycle in the first work station 34, and any time lag in the opening of the box at the first work station will occur when the box presser assembly 80 has interrupted the movement of the surface conveyor 25.

The disclosed carton sealing system 9 has been contructed to function on boxes of two sizes and to accept boxes of much smaller sizes without functioning. The very small boxes would be hand closed and sealed prior to being moved on the conveyor system and would pass with the other boxes through the conveyor system without being operated on by the elements of the system.

The smaller boxes would not be of sufficient height to be detected by the photoelectric cells or by the control valves of the system except for the gate control valve 30. Thus, the control gate 26 would function to create a space between the smaller boxes and the next adjacent boxes, but the smaller boxes would pass through the system without being engaged by the elements of the system.

Box height detector valve 110 is located adjacent support legs 72*c* of box closer assembly 70 and its actuator 111 extends out into the path of an oncoming box. The height of the actuator 111 is positioned above the expected maximum height of a small size box moving through the second work station 69 and in the expected path of an oncoming large size box. Box height detector valve 110 controls double acting fluid actuated ram 75 of box closer assembly 70 and the double acting fluid actuated rams 92*a* and 92*b* of box presser assembly 80. The box height detector valve 110 causes the ram 75 of the box closer assembly to move presser plate 78 down a short distance when engaged by an oncoming box and down a further distance when not engaged by an oncoming box. When the box height detector valve 110 is engaged by a tall box it moves the movable presser conveyor assembly up to an elevation corresponding to the height of the tall box, and when an oncoming box does not engage the valve, the movable presser assembly is moved down to an elevation corresponding to the height of the short box. Thus, a box closer assembly and the box presser assembly function to move the top section 12 of a box in a downward direction a distance corresponding to the size of the box so that they will move the top sections of the smaller boxes down to their fully closed positions and yet will not attempt to crush the top sections of the larger boxes.

Figure 3B:
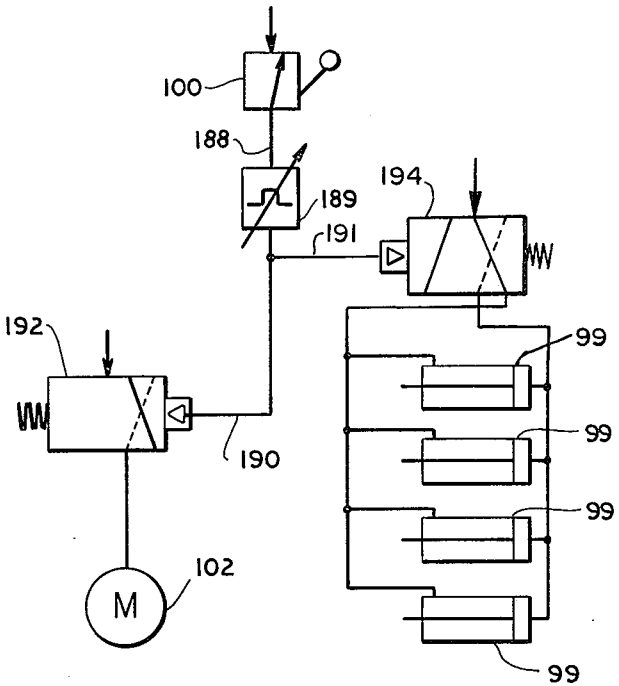
FIGS. 3A and 3B are schematic illustrations of the control system.
Figure 3A:
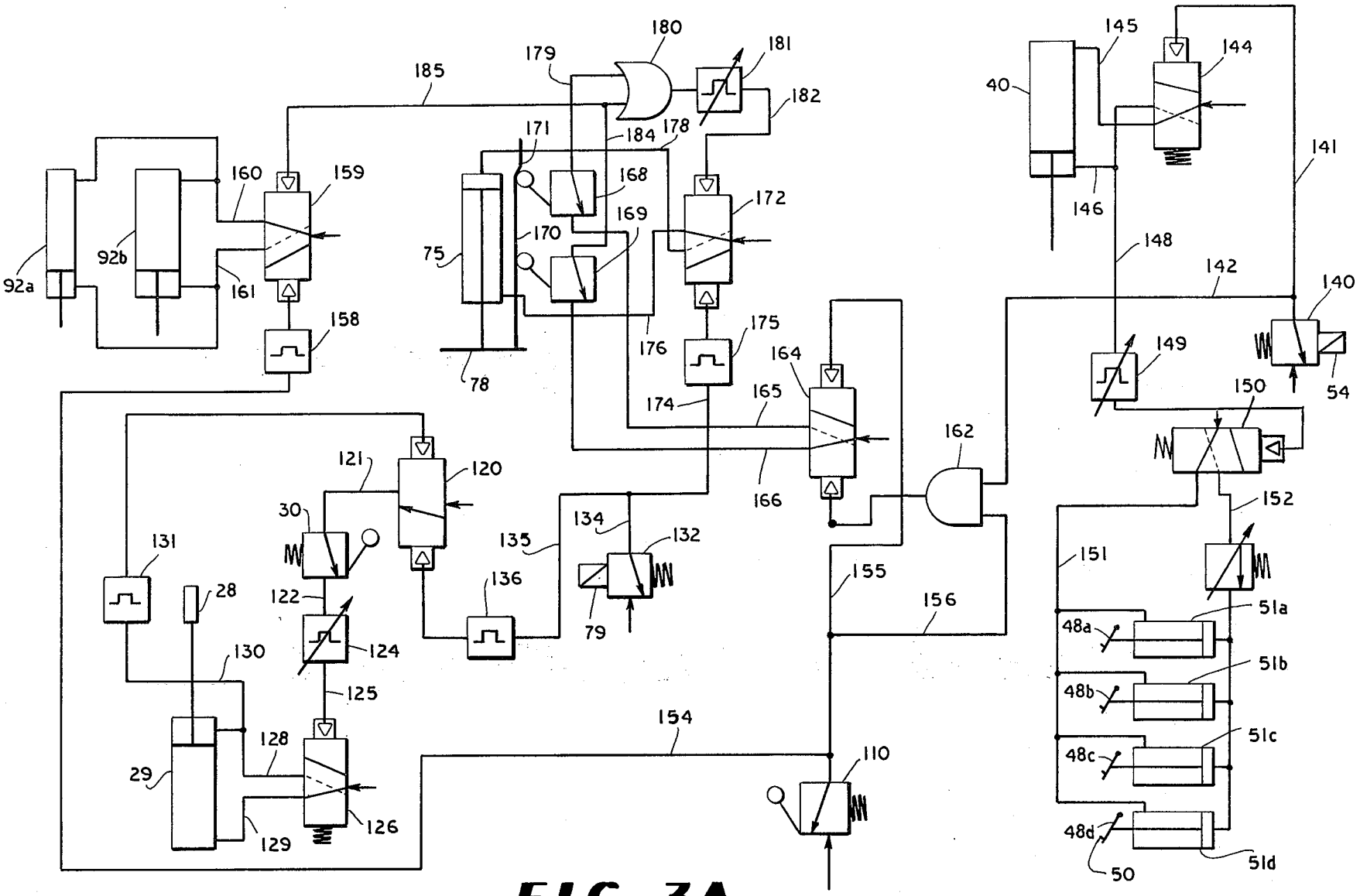

The air control system is illustrated in FIGS. 3A and 3B. The box control gate element is controlled by air under pressure transmitted from a supply (not shown) to shuttle valve 120 (FIG. 3A) through conduit 121, through gate control valve 30, through conduit 122, to timer 124, through conduit 125 to spring biased valve 126. A supply of pressurized air is passed through spring biased valve 126 to either of conduits 128 or 129 to opposite sides of gate control ram 29, while the opposite end of the ram is vented back through the spring biased valve 126. A branch conduit 130 communicates with conduit 129 and passes through timer 131 and communicates with the opposite side of shuttle valve 120. Photocell 79 which is the second photocell in the path of the boxes in the carton sealer system actuates its valve 132 to allow pressurized air to pass through conduits 134 and 135 through time delay 136 to the other end of shuttle valve 120. When the photocell 179 detects darkness or a box passing through box closer assembly 70, it charges shuttle valve 120, causing shuttle valve 120 to shift from the position indicated to its open position, whereupon pressurized air will pass from valve 120 through conduit 121 to gate control valve 30. When a box is moved by the first feed conveyor 24 up toward engagement with control gate 26 and engages the gate control valve 30, the gate control valve 30 will allow the air to pass through its timer 124 to a spring biased valve 126, shifting the valve from the position indicated where the bottom of the ram is pressurized with its ramrod distended and the top of the ram vented to the opposite condition where the bottom of the ram is vented and the top of the ram is pressurized to retract the gate element 28. The branch conduit 130 also communicates the air pressure through impulse timer 131 to the top of shuttle valve 120, and the pulse of air tends to shift the shuttle valve 120 back to its position as illustrated, cutting off the supply of air to the spring biased valve 126. The spring of the spring biased valve 126 thereupon moves the valve 126 back to the position indicated, whereupon the ram 29 lifts the gate element 28 back to its position where it blocks the passage of boxes onto the surface conveyor 25 of the carton sealer system. Thus, the presence of the preceding box moving past the second photocell at the box closer assembly 70 is required to admit the next carton waiting at the control gate.

As a carton moves from the control gate into the first work station 34, its presence is detected by photoelectric cell 54, which is the first photoelectric cell in the path of the system. Photoelectric cell 54 shifts its valve 140 so as to allow air under pressure to communicate with conduit 141 and 142. Conduit 141 leads to a spring biased valve 144, and the pressurized air passes through valve 144 to the bottom or to the top of double acting fluid actuated ram 40 of the carton lifter. The carton lifter is normally maintained in its down position, so that the pressurized air normally passes through spring biased valve 144 to conduit 145 to the upper end of the ram, while the lower end of the ram is vented through conduit 146 back through the valve 144. When the photocell 54 detects darkness, its valve 140 shifts the spring biased valve 144 to allow pressurized air to communicate with the lower end of ram 40 and to allow the upper end of the ram to vent to the atmosphere whereupon the reciprocating support spider assembly 42 is moved in an upward direction. Conduit 148 also communicates with conduit 146 and passes through a one shot timer 149 to one end of a spring biased valve 150. Pressurized air communicates through spring biased valve 150, through conduits 151 and 152 to opposite ends of the fluid actuated double acting rams 51*a*, 51*b*, 51*c* and 51*d*. The spring of the valve 150 causes the valve to be in the position where the pressurized air normally communicates through conduit 151 to rams 51*a*–51*d*, to cause the rams to be in their retracted conditions. When valve 150 is actuated by the air pressure received through its timer 149 from valve 144, the valve 150 causes the pressurized air to communicate with the opposite ends of rams 51*a*–51*d*, causing the rams to distend temporarily, whereupon the top sections of the boxes are impaled by the pins 50 as the reciprocating support spider assembly 42 is lifted, causing the top sections of the cartons to be lifted. The rams 51*a*–51*d* remain distended until one shot timer 149 bleeds the air from the end of valve 150, whereupon the spring of the valve shifts the valve back to the position illustrated and causes the rams 51*a*–51*d* to retract.

After a box leaves first work station 34 and moves to the second work station, the height of the box is detected by the box height detector valve 110. If the height of the box is low, the valve 110 will not be shifted, so the system will function to handle a box of low height. If the valve 110 is engaged by an oncoming box, then the system detects the oncoming tall box and pressurized air is allowed to pass through valve 110 through conduits 154, 155 and 156. The air passing through conduit 154 passes through timer 158 to one end of the shuttle valve 159, causing the valve to shift upwardly. Pressurized air moves through valve 159 through conduits 160 and 161 to the opposite ends of double acting fluid actuated rams 92*a* and 92*b*. When the shuttle valve 159 is in the position illustrated, the air under pressure communicates through conduits 150 to the upper ends of rams 92*a* and 92*b*, causing the rams to distend their ramrods and move the movable presser conveyor assembly 85 to its down position. When the box height detector valve 110 detects an oncoming tall box, it causes shuttle valve 159 to shift from the position illustrated to the position where conduit 161 is pressurized and conduit 160 is vented, whereupon the lower ends of rams 92*a* and 92*b* are pressurized and lift the movable presser conveyor assembly 85 to accept the taller box.

When the first photoelectric cell 54 detects a box entering the first work station 34, its valve 140 pressurizes conduit 142 which passes air through the NOT valve 162 to the upper end of shuttle 164. Thus shuttle valve 164 is moved to the position indicated in the drawing on each cycle of operation of the box lifter unless the box height detector valve 110 is actuated, whereupon air under pressure is charged through conduit 156 to NOT valve 162, which causes no air to be transmitted through the NOT valve to the upper end of shuttle valve 164. Since the conduit 155 is simultaneously pressurized with conduit 156, the opposite end of shuttle valve 164 will be charged, shifting the shuttle valve 164 from the position indicated to its opposite position. Shuttle valve 164 communicates through conduits 165 and 166 to either of upper or lower pressure limit valves 168 or 169. A cam 170 is mounted on the presser plate 78 and its protrusion 171 engages lower and upper presser limit valves 168 or 169 on each reciprocation of the double acting pneumatic ram 75.

Shuttle valve 172 receives an impulse of pressurized air at its lower end from conduit 174 and impulse valve 175 from the second photocell 79 at the box closer assembly 70, and the impulse of pressurized air shifts the shuttle valve 172 from the position indicated to its opposite position. Air under pressure passes through the shuttle valve 172 through conduits 176 and 178 to the opposite ends of double acting ram 75. The ram is normally maintained in its retracted or up position until the photocell 79 detects an oncoming box at the box closer assembly 70, whereupon the shuttle valve 172 is shifted from its position indicated so that the lower end of the ram 75 is vented and the upper end of the ram is pressurized, whereupon the presser plate 78 begins to move in a downward direction. If the box height detector valve 110 has detected a tall box moving into the box closer assembly 70, it will have charged valve 168 through the shuttle valve 164 as previously described, whereupon when the protrusion 171 of cam 170 engages the upper pressure limit valve 168, air is passed from shuttle valve 164 through upper pressure limit valve 168 through conduit 179 to OR valve 180, through timer 181, conduit 182, to the upper end of shuttle valve 172, thus shifting shuttle valve 172 back to its illustrated position, whereupon the pressure in ram 75 is reversed to stop the downward movement of the ram and to lift the presser plate 78 upwardly.

If the box height detector valve 110 did not detect a tall oncoming box, shuttle valve 164 will have remained in its illustrated position, therefore charging the lower pressure limit valve 169 and leaving the upper pressure limit valve 168 uncharged, so that when the protrusion 171 of the cam 170 moves past the upper presser limit valve 168, the closing of the valve will not function to charge the conduit 179 with pressure, and the presser plate 78 will continue to move in a downward direction until the protrusion 171 of its cam 170 engages the lower presser limit valve 169, whereupon air passes through the valve 169, through conduit 184 to the OR valve 180, thus shifting the shuttle valve 172 back to its illustrated position, and also charging conduit 185. Conduit 185 communicates with the upper end of shuttle valve 159, which shifts the shuttle valve to the position illustrated, charging the upper ends of rams 92*a* and 92*b* of the box presser assembly 80, which moves the movable presser conveyor assembly 85 to its lowered position to engage the smaller box.

As illustrated in FIG. 3B, the control valve 100 of the box presser assembly 80 is charged with pressurized air, and when the valve is engaged, it pressurizes conduit 188, timer 189, and conduits 190 and 191. Conduit 190 actuates spring biased valve 192 to shift the valve from the position indicated, where pressurized air passes through the valve 192 to the brake-clutch assembly of the driving motor 102. This interrupts the movement of surface conveyor 25 and the belt conveyor 89 of the movable presser conveyor assembly 85. The pressure through conduit 191 communicates with the spring biased valve 194 to shift the valve against the bias of its spring from the position indicated to its alternate position. The spring of the valve 194 normally maintains the valve in the illustrated position, where the rams 99 of the side presser assemblies 95 are retracted. When a box is received in the box presser assembly 80 and actuates the control valve 100, the spring bias valve 194 is shifted against the bias of its spring and the rams 99 distend to move the presser fenders 98 inwardly to press the side walls of the boxes inwardly.

While this invention has been described in detail with particular reference to a preferred embodiment thereof, it will be understood that variations and modifications can be effected within the spirit and scope of the invention as described hereinbefore and as defined in the appended claims.

We claim:

1. A method of progressively closing a series of loaded boxess of the type having a bottom section with a bottom wall and upwardly extending side walls and a top section with a top wall and downwardly extending side walls in overlapping telescoped relationship about the side walls of said bottom section as the boxes move along a laterally extending surface conveyor comprising separating the boxes from one another before each box is moved on the surface conveyor into a first work station, lifting the top section of each box upwardly a distance less than the height of the side walls of the bottom section or the height of the side walls of the top section and allowing the weight of the bottom section and the load in the box to telescopically expand the top and bottom sections at the first work station, applying adhesive to the outside surfaces of opposite side walls of the bottom section of each box at a second work station as each box moves through the second work station on the conveyor, moving the top section downwardly to telescopically contract the top and bottom sections together as each box moves through a third work station on the conveyor, and pressing the opposite side walls of the top section inwardly against the side walls of the bottom section to which adhesive was applied while simultaneously pressing down on the top wall of the top section of each box at a fourth work station.

2. The method of claim 1 and wherein the step of separating the boxes from one another comprises restraining the movement of one box on the surface conveyor until a preceding box reaches the first work station.

3. The method of claim 1 and wherein the movement of all of the boxes along the surface conveyor is interrupted during the steps of pressing the opposite side walls of the top section inwardly against the side walls of the bottom section at the fourth work station.

4. The method of claim 1 and wherein the step of lifting the top section of the boxes comprises terminating the movement of the box along the predetermined path as the top section of the box is being lifted.

5. The method of claim 1 and wherein the step of lifting the top section of the boxes includes impaling the opposite side walls of the top section of the box with a plurality of pointed objects and moving the objects upwardly until the lower edges of the side walls of the top section are lifted a predetermined distance, withdrawing the pointed objects from the side walls of the top section and holding the top section in its lifted position until the bottom section telescopes downwardly into contact with said surface conveyor.

6. The method of claim 1 and further including the step of detecting the height of the box, and wherein the step of pressing the top section downwardly comprises pressing the top section downwardly a distance corresponding to the height of the box in response to the detection of the height of the box.

7. A process for packing boxes of the type including a bottom section with a bottom wall and upwardly extending side walls and a top section including a top wall and downwardly extending side walls extending in telescoped relationship about the side walls of the bottom section comprising the steps of conveying the boxes in sequence in a lateral path along a surface conveyor, lifting the top section of each box upwardly and holding the top section upwardly until the bottom section telescopes downwardly partially out of the top section and into contact with the surface conveyor, applying adhesive to the outside surface of the side walls of the bottom section of each box after the bottom section contacts the surface conveyor, urging the top section of each box downwardly to move the side walls of the top section over the adhesive, and simultaneously pressing the top wall and side walls of the top section inwardly.

8. The process of claim 7 and wherein the step of lifting the top section of each box includes interrupting the movement of the box on the surface conveyor until the top section has been lifted and the bottom section telescopes downwardly into contact with the surface conveyor and continuing the movement of the box on the surface conveyor after the bottom section telescopes downwardly into contact with the surface conveyor.

9. Apparatus for progressively sealing a series of loaded boxes of the type including a bottom section with uupwardly extending side walls and a top section with downwardly extending side walls extending in telescoped relationship about the side walls of the bottom section comprising a surface conveyor system for moving a series of boxes along a path, gate means for interrupting the movement of the boxes along the path, means for elevating the top section of each box with respect to its bottom section to expose the outside surface of the side walls of the bottom section of the box, means for applying adhesive to the exposed outside surfaces of the side walls of the bottom section of each box, means for closing the top section downwardly onto the bottom section, and means for simultaneously pressing the top section downwardly and pressing the side walls of the top section inwardly.

10. Apparatus for sealing a series of loaded boxes of the type including a bottom section with a bottom wall and upwardly extending side walls and a top section with a top wall and downwardly extending side walls telescoped about the side walls of the bottom section comprising a surface conveyor for moving boxes in series along a horizontal path, gate means for interrupting the movements of the boxes along the path and for forming spaces between adjacent ones of the boxes, opening means positioned along the path for lifting the top section of each box upwardly, adhesive applicator means for applying adhesive to the side walls of the bottom section of each box, a box closer for urging the top section of each box downwardly toward the fully closed condition of each box, and side pressing means for urging the opposite side walls of the top section inwardly.

11. The apparatus of claim 10 and further including detecting means for determining the height of the box with the top section lifted, said box closer being responsive to said detecting means to urge the top section downwardly a predetermined distance.

12. The apparatus of claim 10 and further including means for holding the top sections of the boxes down as the side pressing means urge the opposite side walls of the top inwardly, and detecting means for determining the vertical size of each box, said means for holding the top sections of each box down being responsive to said detecting means to hold the top sections to a level as determined by said detecting means.

* * * * *